United States Patent [19]

Holman et al.

[11] Patent Number: 4,732,102

[45] Date of Patent: Mar. 22, 1988

[54] PORTABLE, SELF-CONTAINED, SELF-ADJUSTABLE CRAFT LIFT AND WET/DRY STORAGE SYSTEM

[76] Inventors: Clifford W. Holman, 27700 NE. 132nd Ave.; Ralph V. Peabody, 21101 NE. 267th St., both of Battle Ground, Wash. 98604

[21] Appl. No.: 59,148

[22] Filed: Jun. 5, 1987

Related U.S. Application Data

[63] Continuation of Ser. No. 837,675, Mar. 10, 1986, abandoned.

[51] Int. Cl.[4] ..... B63B 35/34

[52] U.S. Cl. ..... 114/45; 114/48

[58] Field of Search ..... 114/44–48, 114/258, 259, 261, 262, 267; 405/4, 7; 280/414.1, 414.3

[56] References Cited

U.S. PATENT DOCUMENTS

| | | | |
|---|---|---|---|
| 9,244 | 11/1835 | Porter | 114/45 |
| 47,501 | 1/1865 | Turner | 114/48 |
| 2,394,764 | 2/1946 | Greulich | 114/267 |
| 3,045,839 | 7/1962 | Hibberd | 114/44 |
| 3,265,024 | 8/1966 | Kramlich | 114/45 |
| 3,406,649 | 10/1968 | Burkhort | 114/45 |
| 3,415,212 | 12/1968 | Hennig | 114/45 |
| 3,446,172 | 5/1969 | Morton et al. | 114/267 |
| 3,777,691 | 12/1973 | Beale | 114/48 |
| 3,857,352 | 12/1974 | Schott | 114/267 |
| 4,279,565 | 7/1981 | Verdy | 280/414.3 |

FOREIGN PATENT DOCUMENTS

| | | | |
|---|---|---|---|
| 2260542 | 6/1974 | Fed. Rep. of Germany | 114/45 |
| 60-12392 | 1/1985 | Japan | 114/45 |

*Primary Examiner*—Joseph F. Peters, Jr.
*Assistant Examiner*—Edwin L. Swinehart
*Attorney, Agent, or Firm*—Marger & Johnson

[57] ABSTRACT

The invention comprises an improved system for raising, lowering and wet/dry storing of a craft supported thereon. This improvement includes pontoon means and structural frame means, respectively, for supporting said craft. The pontoon means and structural frame means are disposed for coactive movement one with respect to the other. The coactive operation of this system during the raising/lowering of the craft provides self-adjustability to the system. The amplitude of coactive movement of the pontoons/frame means can be limited so that the craft is not moved beyond its fully raised and lowered positions. This coactive movement and, more particularly, this limited coactive movement, is contrary to prior art boat lifts that include a fixed, immovable support framework in which only the craft lift is moved between respective raised and lowered positions.

21 Claims, 8 Drawing Figures

PORTABLE, SELF-CONTAINED, SELF-ADJUSTABLE CRAFT LIFT AND WET/DRY STORAGE SYSTEM

This application is a continuation of application Ser. No. 06/837,675, filed Mar. 10, 1986 now abandoned.

BACKGROUND OF THE INVENTION

This invention relates to an improved portable, self-contained, self-adjustable craft lift and wet/dry storage system and to an improved method for raising and lowering the system and for the wet/dry storing of such crafts.

The storage of crafts in water for prolonged periods of time results in substantial problems. First, marine growth, such as, algae, barnacles and the like inhibits maximum boat speed, particularly in the case of sailboats. It also results in long-term damage to the structural integrity of the craft since various chemicals present in the water cause deterioration of the hull and electrolysis of the metal components of the craft. Finally, any leakage problems are exacerbated by being stored in water for long periods of time.

Accordingly, boat lift/storage systems have been developed to alleviate the above-described problems. Most of these prior art systems are part of, or are attached to, a permanent dock. See U.S. Pat. Nos. 3,276,211, Re. 27,090, 3,727,415, 3,777,691, 3,857,248, 3,991,695, 3,967,570, 4,018,179, and 4,037,421. However, the above prior art lift/storage systems are expensive to build and are not readily transportable to another location, certainly not on a cost-effective basis.

Of the known prior art lift/storage systems, some include pontoons to provide buoyancy, such as U.S. Pat. Nos. 3,265,024, 4,027,492, and 4,072,119. However, in these latter cases, the frame itself remains in a fixed position with respect to the pontoons during the raising/lowering operations and does not coact with the lifting mechanism. In addition, the lifting-structural support means required to operate these systems are complex and costly.

The structural framework portion of the above prior art support systems typically have a rectangular cross-sectional configuration which does not conform to the shape of the boat hull. This non-conformity makes it difficult at best for boat self-adjustment, i.e., lateral alignment and/or leveling of the boat within the confines of the system's structural framework. In U.S. Pat. Nos. 3,857,248, 3,991,695, 3,967,570, 4,027,492, and 4,072,119, respectively, rigid, fixed boat hull support elements are provided in an attempt to overcome the self-adjustment problem and to assist in the performance of the boat aligning and leveling operations. However, these support elements are fixed, and they do not readily adjust and conform to the shape of the boat. Instead, these elements require substantial supplemental mechanical adjustment in order to provide structural conformity between the elements and the hull. Therefore, significant alignment and leveling problems still remain unresolved.

Other unresolved problems not recognized by the prior art include boat storage related to seasonal and/or tidal conditions as they affect wet/dry storage, partial lifting of a boat for repair purposes and the lift/storage of deep keel boats.

During the winter season, many bodies of water become frozen due to extremely cold temperatures. It would be desirable to have a storage system which could support a craft on the frozen surface or could also be employed to bring such craft onto shore for storage on the frozen terrain. Furthermore, tidal variations occur which result in the waterline receding to the point where a craft runs aground. Under these latter circumstances, it would also be desirable for a craft storage system to have the ability to be stored both on a body of water or on the bottom when low tide occurs.

Lifting of an entire boat out of the water in order to make certain types of repairs can be a problem. Raising/lowering of either front or back portions of a boat expedites such repairs since a portion of a larger boat can be raised by a given lifting apparatus.

Many sailboats have deep keels. Due to their extended keel size, the requisite clearance does not exist between the keel and the system framework for supporting that sailboat thereon. There is no prior art system designed to affect deep keel storage.

SUMMARY OF THE INVENTION

Contrary to the above prior art devices, the lift and wet/dry storage system of the present invention is portable, self-contained, self-adjusting, capable of supporting a plurality of crafts and designed for both wet and dry craft storage.

In the practice of this invention, a system is provided which is portable and is readily movable from place to place, on water or land, at a relatively low cost.

The system is also self-contained and does not require a dock in order for it to be functional. Thus, a craft can be readily raised, lowered and stored at an accessible water location or stored on land using the subject system.

The present form of the invention comprises an improved system for raising, lowering and wet/dry storing of a craft supported thereon. This improvement includes pontoon means and structural frame means, respectively, for supporting said craft. The pontoon means and structural frame means are disposed for coactive movement one with respect to the other. The coactive operation of this system during the raising/lowering of the craft provides self-adjustability to the system. The amplitude of coactive movement of the pontoons/frame means can be limited so that the craft is not moved beyond its fully raised and lowered positions. This coactive movement and, more particularly, this limited coactive movement, is contrary to prior art boat lifts that include a fixed, immovable support framework in which only the craft lift is moved between respective raised and lowered positions.

A preferred feature of the present invention, which facilitates self-adjustability, is directed to a lift/storage system comprising sloping sides that cause further horizontally directed forces from the pontoons. This is turn causes the pontoons to self-adjust and exert a stabilizing effect on the frame for maintaining the craft in proper lateral and level alignment. It is also contemplated that when the craft is raised, the pontoons will be moved to a position not to substantially exceed the outer lateral extent of the frame means. This is of particular importance when only boat slips of minimum widths are available.

In another inventive feature, flexible support means attached to the structural frame means conforms to a substantially unlimited number of hull configurations, and facilitates alignment and leveling of the craft by providing substantially total engagement of the flexible support means and the craft hull during the raising and lowering operations.

The present invention is also concerned with the "partial" raising and lowering of the respective front or rear portion of a craft. This can be accomplished by employing a modified version of the subject lift and wet/dry storage system. In this case, a laterally-extending flexible support means attached at its respective ends to a pair of substantially horizontal longitudinally-extending support members of a modified structural frame means. When this flexible support means engages the rear or front of the craft hull, only that portion of the craft will be lifted. This feature facilitates repair operations since much heavier crafts can be partially lifted than can be fully supported.

The lift/storage system of this invention is also capable of supporting thereon a plurality of watercrafts and, with minor modifications, a plurality of aircrafts. This can be accomplished by sizing the respective pontoons and the structural frame according to the dimensions and weight of a given craft. Furthermore, the above-described flexible support means can be detachably connected to the frame to provide the requisite clearance for the lifting and storing of deep keel sailboats.

In another important feature of this invention, the lift/storage system can be equipped with skid means attached to the bottom of the structural frame means to enable this portable self-contained craft lift/storage system to be stored on land as well as in the water.

DETAILED DESCRIPTION OF THE INVENTION

Figure 1:
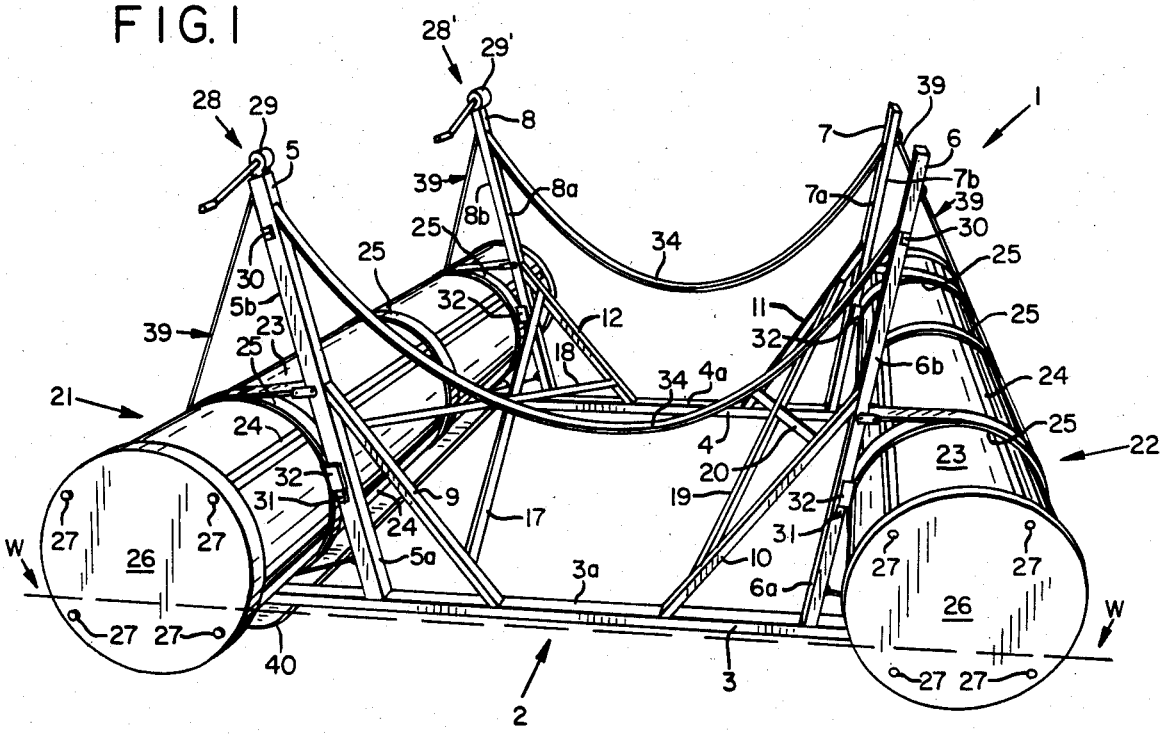
FIG. 1 is a perspective view of a watercraft lift and wet/dry storage embodying the present invention.
Figure 2:
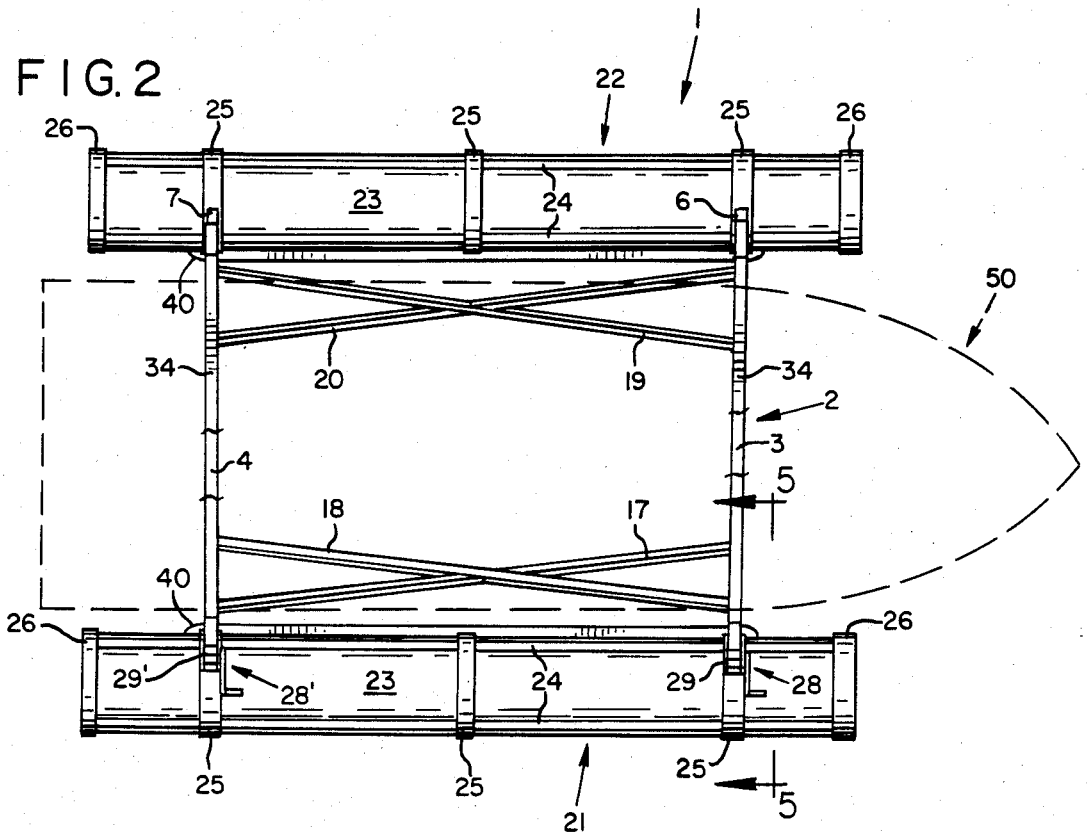
FIG. 2 a top plan view of the system of FIG. 1, including a portion of a boat (shown in broken lines) supported thereon.
Figure 3:
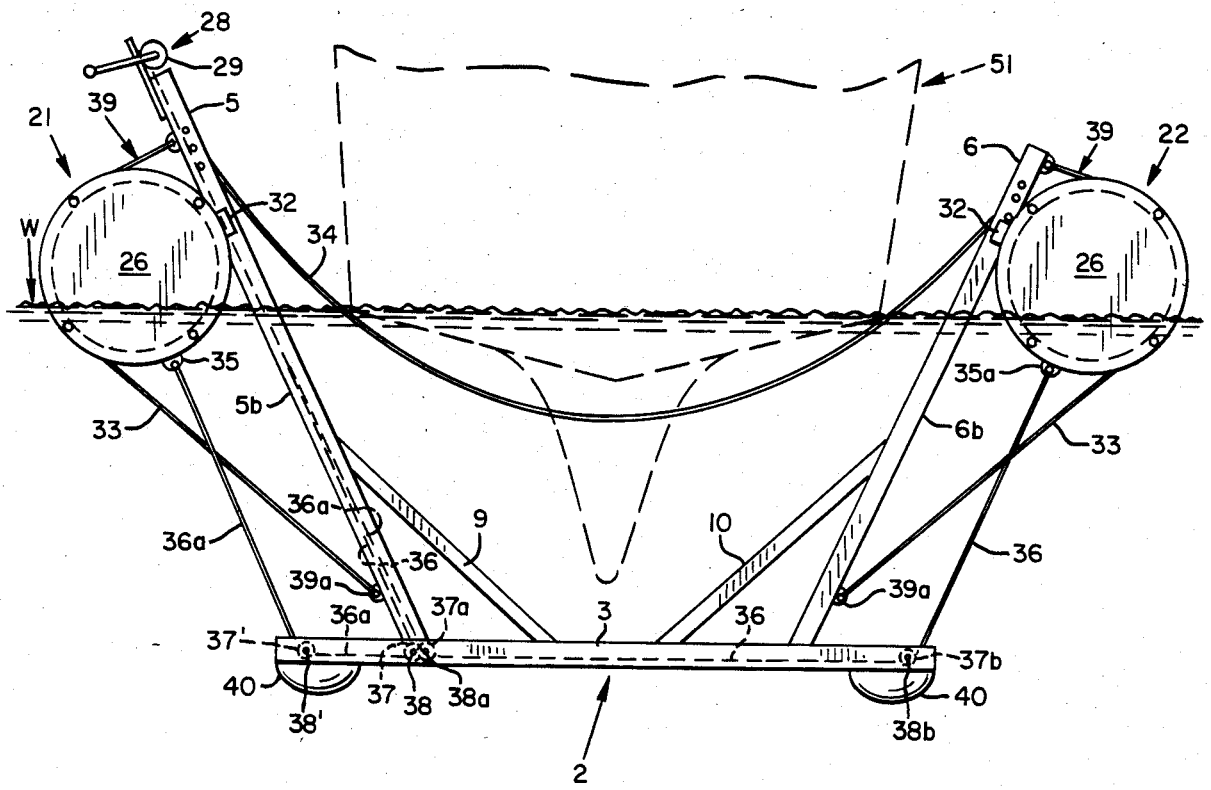
FIG. 3 is an end view of the system of FIG. 1, in the lowered position, including a portion of a deep-keeled boat (shown in broken lines) positioned therewithin.
Figure 4:
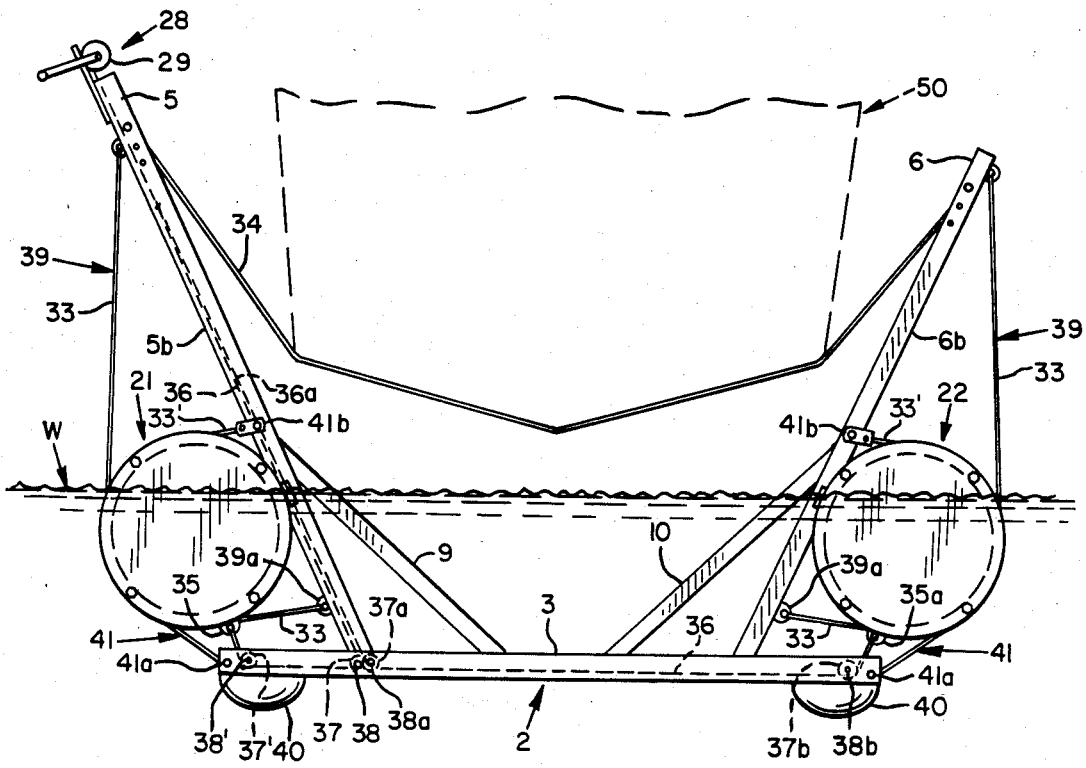
FIG. 4 an end view of the system of FIG. 1, in the raised position, including a portion of a boat (shown in broken lines)

Referring now to FIGS. 1 thru 4, a preferred lift and wet/dry storage system 1 is depicted. System 1 generally comprises structural frame means 2 for supporting a craft 50 or 51 during the raising, lowering and wet/dry storage of said craft. More specifically, frame means 2 comprises a pair of spaced-apart, substantially parallel, laterally-extending base members 3 and 4. A pair of upwardly-extending frame members 5 and 6 are mounted on base member 3, and a second pair of upwardly-extending frame members 7 and 8 are mounted on base member 4. Respective frame members 5 and 6 and frame members 7 and 8 on opposite sides of said frame means 2 being spaced apart, one with respect to the other, at a distance which is substantially the same and which is sized to readily accept craft 50 or 51 within its confines.

Bracing members 9 and 10 are joined at one end to, and bracingly support the inner sides 5*a* and 6*a* of, respective frame members 5 and 6. Bracing means 9 and 10 are joined at their other ends to the upper side 3*a* of base member 3. In a similar manner, bracing members 11 and 12 are joined at one end to, and bracingly support the inner sides 7*a* and 8*a* of, respective frame members 7 and 8. Bracing members 11 and 12 are joined to the upper side 4*a* of base member 4.

It should be noted, however, that the configuration, number and location of any bracing members in structural frame 2 can be modified as required for a particular use.

Figure 5:
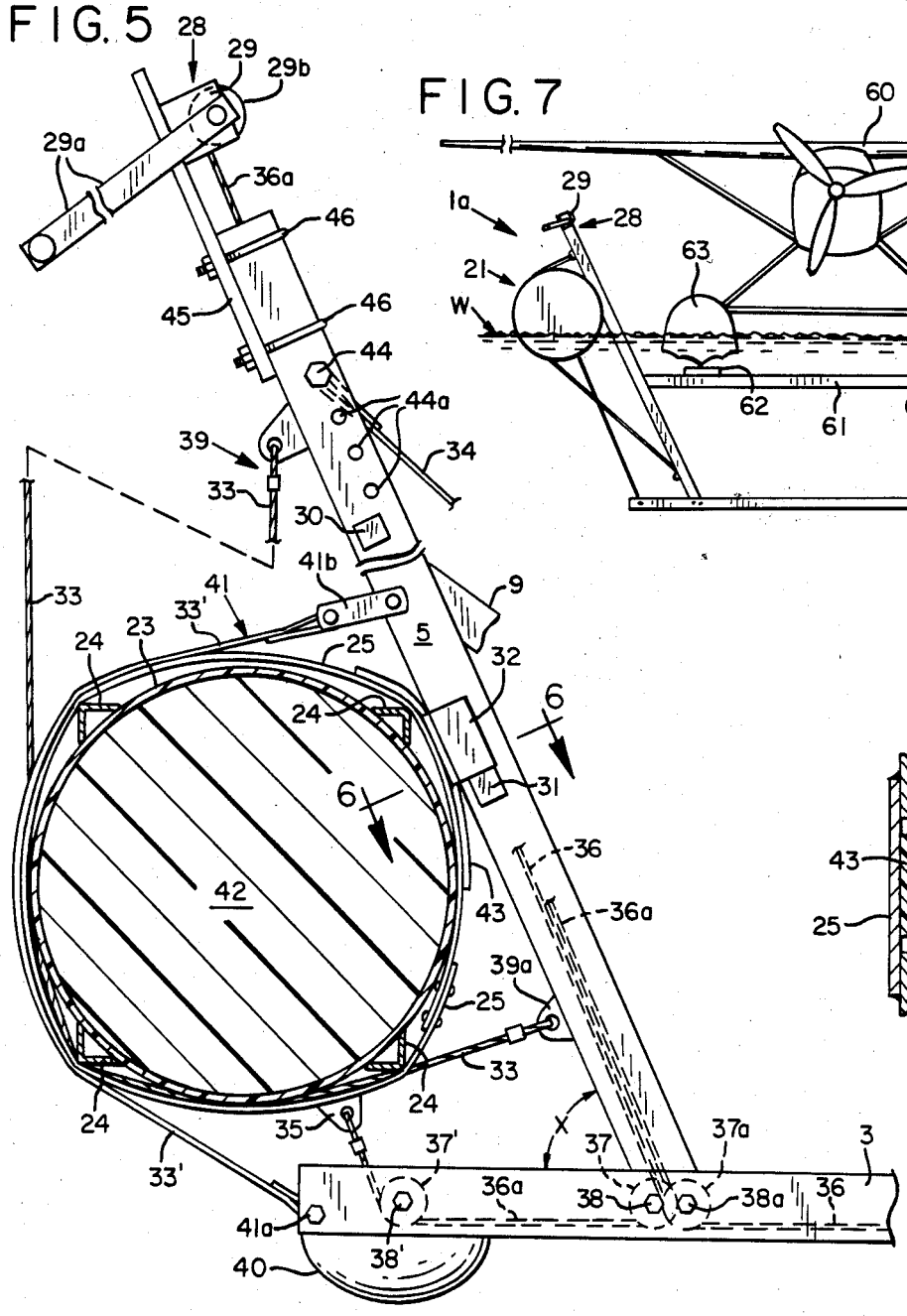
FIG. 5 is an enlarged sectional view of the floatation system of FIG. 2, taken along line 5—5 in the direction of the arrows.

Upwardly-extending frame members 5 through 8 together form a cradle-like configuration within which craft 50 or 51 can be disposed for purposes of said raising, lowering and storage operations. Although the frame members 5-8 can extend in a substantially vertical disposition, it is preferred that these frame members extend in an angular direction outwardly from base members 3 and 4, respectively. The complementary angle formed by frame members 5 and 6 and the horizontal axis of frame 2, and by frame members 7 and 8 and the horizontal axis of frame 2, is designated in FIG. 5 as angle X. Preferably, angle X is more than about 45 degrees and less than about 90 degrees. This sloping disposition of members 5–8 allows further horizontally directed forces to be imparted thereto by pontoons 21 and 22, thereby exerting a stabilizing effect on frame means 2 for maintaining the craft in proper lateral and level alignment. And, as can be most readily seen in FIG. 4, when frame means 2 is in the raised position, pontoon means 21 and 22 are moved to a position which does not substantially exceed the outer lateral extent of frame means 2.

Longitudinally-extending cross-brace support means 17 thru 20 act to interconnect and reinforce structural frame means 2. Cross-brace support means 17 and 18 are joined at one end to the respective upper and lower portions of frame member 9, cross each other and are joined at substantially their respective midpoints, and are then secured to the opposite upper and lower portions of frame member 12. In a similar manner, longitudinally-extending cross-brace support means 19 and 20 are connected at one end to the respective upper and lower portions of frame member 10, cross each other and are joined at substantially their midpoints, and are then secured to the opposite upper and lower portions of frame member 11. Typically, structural frame means 2 is fabricated from a metallic material capable of withstanding the biological and chemical components contained in the body of water in which the system is immersed, such as, galvanized steel or aluminum and the like.

As depicted in FIGS. 1–5, a pair of spaced-apart, longitudinally-extending pontoon means 21 and 22 are connected for slideable engagement to structural frame means 2, as hereinafter described, and buoyantly support in water said frame means 2 during the raising, lowering and wet storage operations. Pontoon means 21 and 22 each preferably comprise a longitudinally-extending floatation cylinder means 23, generally fabricated from a polymeric material such as PVC, polyethylene, or polypropylene. The cylinder means 23 is filled with an expanded, typically rigid, polymeric foam material 42. Alternatively, for example, floatation devices such as foam-filled tires and the like can be employed to buoyantly support said frame means 2. A plurality of spaced-apart, longitudinally-extending stiffening members 24, preferably in the form of metal angle bars, are disposed about the cylinders 23 in order to provide the structural rigidity thereto. End cap means 26 attached to said cylinder means 23 are disposed at the respective ends of cylinder means 23 for closing off and protecting same from impact thereto. End caps are maintained in position by attachment means 27 which pass through the end caps 26 and are connected to stiffening means 24. A plurality of band members 25 are provided which extend circumferentially about such respective cylinder means 23 and stiffening members 24 for retaining said stiffening members 24 in position with respect to cylinder means 23.

Further referring to FIGS. 1–5, lift means 28 and 28' are joined to pontoon means 21 via lift cables 36*a*, and to pontoon means 22 via lift cables 36, for raising and lowering craft 50 or 51. More specifically, lift means 28 and 28' comprises respectively winch means 29 and 29', including winch handles 29*a* and winch reels 29*b*, which are affixed to winch attachment plate means 45. Winch 28 and 28' are respectively mounted to the upper portion of frame members 5 and 8 by winch attachment means 46, which for purposes of illustration is a U-bolt, passing thru said respective attachment plate means 45 and about frame members. Frame members 5 and 8 and base members 3 and 4 each preferably have a hollow rectangular interior cross-sectional configuration within which passes cables 36 and 36*a* for attachment to pontoon means 21 and 22. Cables 36 and 36*a* extend downwardly from winches 29 and 29' and pass about sheaves 37 and 37*a* which are rotatably mounted on sheave pins 38 and 38*a*, respectively. Cables 36 and 36*a* then diverge in a horizontal direction with cable 36*a* passing about sheave 37', which is rotatably mounted on sheave pin 38', and then extends upwardly where it is coupled to lift cable connector means 35 secured to the underside of pontoon means 21. In a similar manner, cables 36 pass about sheave 37*b*, which is rotatably mounted on sheave pin 38*b* and then extends upwardly where it is coupled to lift cable connector means 35*a* secured to the underside of pontoon means 22.

Figure 6:
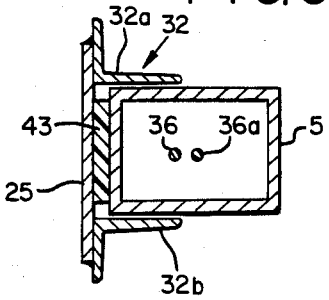
FIG. 6 is an enlarged sectional view of self-adjusting guide means 32 of the floatation system of FIG. 5, taken along line 6—6 in the direction of the arrows.

Pontoon means 21 are connected for slideable engagement to frame members 5 and 8 for movement in an upward and downward direction via self-adjusting guide means 32. Pontoon means 22 are similarly slideably connected to frame members 6 and 7. The particular self-adjusting guide means depicted in FIG. 6 comprises a U-shaped coupling means 32 fastened to pontoons 21 and 22 and connected for slideable engagement with outer sides 5*b* and 8*b* of frame members 5 and 8 and outer sides 6*b* and 7*b* of frame members 6 and 7, respectively. More specifically, U-shaped coupling means 32 comprises slide plate 43 and angles 32*a* and 32*b* affixed to band member 25 thereby forming a substantially U-shaped cross-sectional inner configuration for engaging said frame members 5 thru 8.

The movement of self-adjusting guide means 32, and in turn the movement of pontoons 21 and 22, with respect to frame members 5 through 8 are upwardly limited by pontoon means upper limit stops 30 and are downwardly limited by pontoon means lower limit stops 31. Stops 30 and 31 typically comprise metal tabs, generally rectangular in shape, affixed to said frame members.

Pontoon means are contained and limited for movement in an upward and downward direction between respective raised and lowered positions by restrainer cable means 39 disposed about said pontoon means. The restrainer cable means 39 comprises restrainer cables 33 coupled near the upper and lower ends of frame members 5 thru 8.

Structural frame means 2 can be more effectively sustained in the raised position for wet storage of crafts 50 or 51 by interlockingly engaging safety cable means 41 disposed about pontoons 21 and 22 so that structural frame means 2 is thereby hindered from downward movement. Safety cable means 41 comprises respective cables 33' disposed about said respective pontoon means 21 and 22 by attachment to respective frame members 5 thru 8 and respective base members 3 and 4. The safety cable means is secured to said base members 3 and 4 at one end 41*a* immediately below said pontoon means 21 and 22 and is detachably secured to respective frame members 5–8 at the other end 41*b* immediately above said pontoon means 21 and 22.

Flexible support means 34 are preferably provided which engage the hull of craft 50 or 51 for assisting in the raising, lowering and storage thereof. Since flexible support means 34 conforms to a substantially unlimited number of craft hull configurations, alignment and leveling of the craft is facilitated by the substantially total engagement of the hull with support means 34 during the raising and lowering operations. Preferably, support means 34 comprises a pair of spaced-apart flexible straps detachably connected to frame members 5 and 6 and frame members 7 and 8, respectively, by detachable connector means 44, disposed within one of a series of adjustment holes 44*a*. The detachability of flexible support means 34 provides deep-keeled craft 51 (see FIG. 3) with the requisite clearance, on detachment, so that it can readily be moved onto the system 1. Once in place, the flexible support means 34 can be reattached.

Figure 7:
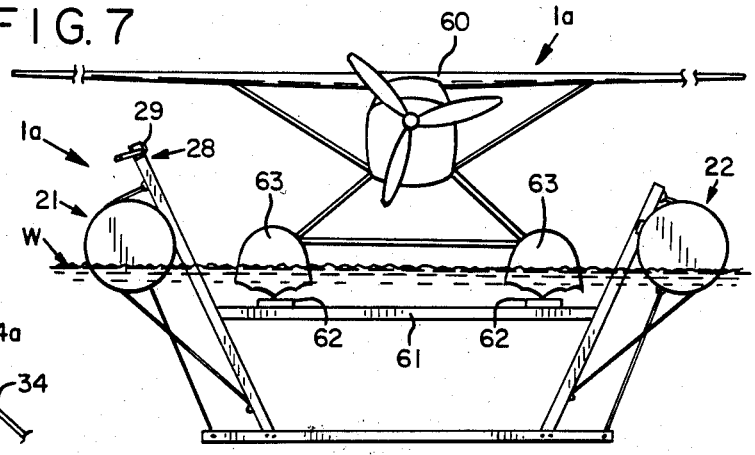
FIG. 7 is an end view of the system of FIG. 1 in the lowered position with an aircraft located thereon, modified to accept such aircraft.

In FIG. 7, a preferred embodiment of this invention is depicted which comprises a lift and wet/dry storage system la modified to support aircraft 60. Modified system la includes horizontal support member 61 having longitudinal support members 62 disposed thereon for receiving aircraft pontoons 63 supported thereon.

Figure 8:
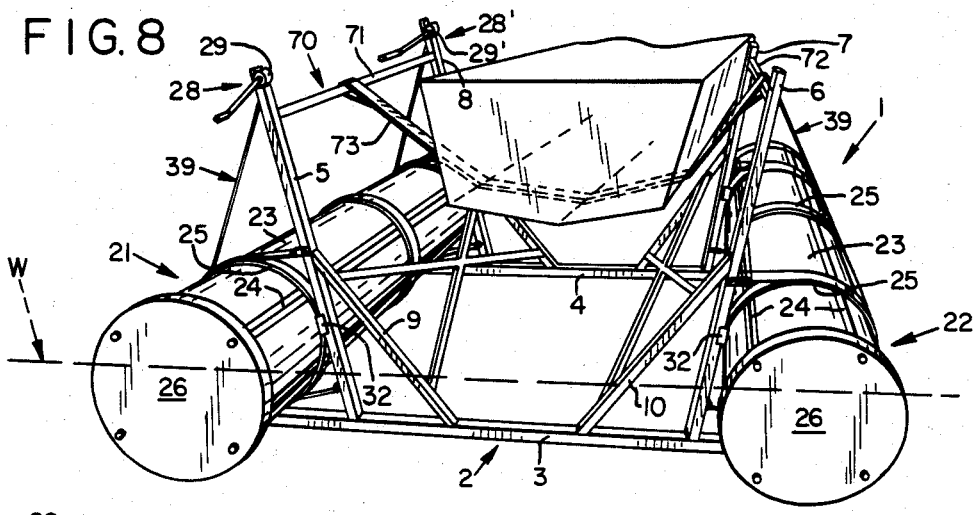
FIG. 8 perspective view of the system of FIG. 1 modified for use as a partial raising/lowering system.

In accordance with one aspect of this invention which is depicted in FIG. 8, a portable, self-contained, self-adjustable system 70 can also be provided for the raising and lowering of only the respective front or rear portion of a craft. Longitudinally-extending substantially horizontal support member 71 is attached at its respective ends to the upper portion of respective upwardly-extending frame members 5 and 8. Similarly, longitudinally-extending, substantially horizontal support member 72 is attached at its respective ends to the upper portion of respective upwardly-extending frame members 6 and 7. A laterally-extending flexible support means 73, similar in design to support means 34, is connected at its respective ends to respective longitudinally-extending, substantially horizontal support members 71 and 72. Flexible support means 73 is connected to support members 71 and 72 at an intermediate point. Preferably, this connection is at substantially the midpoint of said support members 71 and 72. In any case, flexible support means 73 is capable of engaging either the front or rear of a craft hull, depending on which end of said craft is to be lifted.

In order to affect dry storage of lift and wet/dry storage system 1, spaced-apart, longitudinally-extending skid members 40 are mounted on the underside of structural frame means 2. This allows system 1 to be located on, for example, a beach when the tide goes out or on frozen terrain when a lake freezes during the winter. Examples of typical skid member can be structure steel angle or channel member, a full or half cylinder (See FIGS. 1–5), treated timber, and the like.

In operation, as generally exemplified in FIGS. 1–5, lift and storage system 1 is first located in a desirable place for the wet storage of craft 50 or 51. Structural frame means 2 are then lowered to a position which will allow the craft to move over said frame means 2. The lowering of structural frame means 2 is accomplished by the operation of lift means 28 and 28'. In exemplary system 1, winch handles **29*a* of winches 29 and 29' are alternately rotated in a counterclockwise direction thereby unwinding respective lift cables 36 and 36*a* disposed on winch reels 29*b* and moving said cables 36 and 36*a* and, in turn,frame means 2, in a substantially vertically downward direction. As previously described, cables 36 and 36*a*, after passing about respective sheaves 37*a* and 37*b*, and 37 and 37', move in an upward direction, which in turn moves respective pontoon means 21 and 22** in an upward direction.

Pontoon means 21 and 22 are preferably moved in a limited upward and downward direction, preferably restricted within the inner confines of restrainer cable means 39, until self-adjusting guide means contacts limit stop 30 and 31. Therefore, the extent of vertically downward and upward movement of support frame means 2 will be equal to the extent of vertically upward and downward movement of pontoon means 21 and 22.

The next step includes introducing the craft onto frame means 2, typically by driving or moving same thereon. Once the craft is in place, the raising and wet storing operations can commence.

When it is desired to raise the craft, the winches are again alternatively rotated, this time in a clockwise direction, thereby winding lift cables 36 and **36*a* onto said winch reels and moving said cables and, in turn, frame means 2 in a substantially upward vertical direction. Pontoon means 21 and 22 are moved in a substantially vertical downward direction, preferably within the inner confines of restrainer cable means 39, during the craft raising operation until self-adjusting guide means 32 contacts limit stop 31. In this case, therefore, moving said craft to a raised position with said lift means and storing same in proper lateral and level alignment is provided by the coactive movement of pontoon means 21 and 22 with respect to said frame means 2**, said pontoon means moving in a substantially vertically downward direction and said frame means moving in a substantially vertically upward direction.

The pontoon means can then be securedly sustained in a raised position during storage by safety cable means 41. After the craft storage period is completed, lowering of craft 50 or 51 is facilitated by coactively moving said pontoon means 21 and 22 in a substantially vertical upward direction with respect to said frame means 2. This lowering operation is accomplished in a similar manner, using lift means 28 and 28', as described above.

We claim the following:

1. A portable, self-contained, self-adjusting craft lift and storage system, designed for both wet and dry craft storage, which comprises:

(a) longitudinally-extending frame means for supporting a craft during the raising, lowering and said wet and dry storage of said craft;

(b) a pair of longitudinally-extending, spaced-apart pontoon means connected to said structural frame means for buoyantly supporting in water said frame means during the raising, lowering and wet storing of said craft; and (c) a plurality of lift means each of which is secured to the underside of both of said pontoon means, said pontoon means coacting with said frame means to provide self-adjustability to said system, said craft being raised by said lift means pulling said pontoon means in a downward direction with respect to said frame means which in turn moves said frame in a upward direction, and said craft being lowered by said lift means by moving said pontoon means in an upward direction with respect to said frame means which in turn moves said frame means in a downward direction.

2. The system of claim 1 wherein said pontoon means are pulled down in a substantially vertically downward direction by said lift means.

3. The system of claim 1 wherein said longitudinally-extending frame means includes upwardly-extending frame members spaced apart at a distance which will facilitate locating of said craft therewithin, and self-adjusting guide means joined to said pontoon means and disposed for slideable engagement with said frame members for movement of said pontoon means in an upward and downward direction therealong.

4. The system of claim 3 wherein the movement of said self-adjusting guide means, and in turn the movement of said pontoon means with respect to said frame members, are upwardly limited by pontoon means upper limit stops and downwardly limited by pontoon means lower stops, each of said respective frame members having a respective upper and lower limit stop affixed thereto.

5. The system of claim 3 wherein said frame members extend in an angular direction outwardly from said structural support frame causing forces to be imparted to said frame members by said pontoon means thereby exerting a stabilizing effect on said frame means for maintaining the craft in proper lateral and level alignment.

6. The system of claim 1 which further includes restrainer cable means disposed about said pontoon means for containing and limiting movement of said pontoon means in an upward and downward direction between respective raised and lowered positions within the confines of said restrainer cable means.

7. The system of claim 1 which further includes flexible support means attached to said frame members which engage the hull of said craft and support same during said raising, lowering and storage operations.

8. The system of claim 7 wherein said flexible support means are detachable from said frame members for supporting deep keeled craft.

9. The system of claim 1 which further includes longitudinally-extending skid means mounted on the underside of said structural frame means for supporting said lift and storage means during dry storage of said craft.

10. The system of claim 5 wherein the angle formed by the frame members and the horizontal axis of said structural frame is greater than 45 degrees and less than 90 degrees.

11. The system of claim 3 wherein said self-adjusting guide means comprises U-shaped coupling means fastened to said pontoon means and mounted for slideable engagement on the outer sides of said respective frame members.

12. The system of claim 1 which further includes safety cable means capable of being interlockingly secured about said pontoon means for hindering said structural frame means from downward movement so that said craft is securedly sustained in a raised position during wet storage thereof.

13. The system of claim 1 which, when said frame means is in the raised position, said pontoon means are moved to a position which does not substantially exceed the outer lateral extent of said frame means.

14. The system of claim 1 wherein said pontoon means comprise:

(a) a longitudinally-extending floatation cylinder means having an expanded polymeric foam material disposed therewithin;

(b) a plurality of spaced-apart, longitudinally-extending stiffening members;

(c) end caps disposed at the respective ends of said cylinder for closing off and protecting same from impact thereto; and (d) a plurality of band members extending circumferentially about said respective cylinder means and stiffening members.

15. An improved method for operating a craft lift and storage system including a structural frame means for raising, lowering and storing a craft, and a pair of spaced-apart pontoon means connected to said structural frame means for buoyantly supporting said frame means during raising, lowering and storing of said craft, which comprises securing a pair of lift means to said pontoon means so that each lift means is secured to the underside of both of said pontoon means, lowering said frame means by moving said pontoon means in an upward direction with respect to said frame means, introducing said craft onto said frame means, raising said craft by coactively moving said pair of pontoon means with each of said pair of lift means in a substantially vertical downward direction with respect to said frame means, and storing said craft in a proper lateral and level alignment, and after said storage period is completed, lowering said craft by coactively moving said pair of pontoon means with each of said pair of lift means in a substantially vertical upward direction with respect to said frame means.

16. The method of claim 15 which further includes the step of moving said pontoon means in a restricted path in an upward and downward vertical direction with respect to said structural frame means.

17. The method of claim 15 which further includes the step of slideably moving said pontoon means in an upward and downward vertical direction with respect to said structural frame means.

18. The method of claim 15 which further includes the step of moving said pontoon means in a limited upward and downward vertical direction, the extent of vertically downward and upward movement of said support frame means being equal to the extent of vertical upward and downward movement of said pontoon means.

19. A portable, self-contained, self-adjusting craft lift and wet/dry storage system, which comprises:

(a) longitudinally-extending frame means for supporting a craft during the raising, lowering and wet/dry storing of said craft, said frame means including a pair of spaced-apart, substantially parallel, laterally-extending base members, and a first pair of upwardly-extending frame members mounted on one of said base members, and a second pair of upwardly-extending frame members mounted on the other base member, said respective first and second pair of upwardly-extending frame members, and said respective pair of base members, each defining a hollow interior section;

(b) a pair of longitudinal-extending, spaced-apart pontoon means connected for slideable engagement to said frame members for buoyantly supporting in water said frame means during the raising, lowering and wet storage operations, said pontoon means including self-adjusting guide means joined thereto and disposed for said slideable engagement in an upward and downward direction along said frame members; and (c) a pair of lift means, including lift cables attached at one end to each of said lift means and passing within each of said hollow interior sections and being attached at the other end to each of said pontoon means, said craft being raised and lowered by each of said lift means moving both of said pontoon means in a respective downward or upward direction with respect to said frame means, which in turn moves said frame means in respective upward or downward direction.

20. A portable, self-contained, self-adjusting craft lift and storage system, designed for both wet and dry craft storage, which comprises:

(a) longitudinally-extending frame means for supporting a craft during the raising, lowering and said wet and dry storage of said craft;

(b) a pair of longitudinally-extending, spaced-apart pontoon means connected to said frame means for buoyantly supporting in water said frame means during the raising, lowering and wet storing of said craft; and (c) lift means mounted to said frame means, without being mounted on said pontoon means, and secured to the underside of said pontoon means, said pontoon means coacting with said frame means to provide self-adjustability to said system, said craft being raised by said lift means pulling said pontoon means in a downward direction with respect to said frame means which in turn moves said frame means in an upward direction, and said craft being lowered by said lift means moving said pontoon means in an upward direction with respect to said frame means which in turn moves said frame means in a downward direction.

21. A portable, self-contained, self-adjusting craft lift and storage system, designed for both wet and dry craft storage, which comprises:

(a) longitudinally-extending frame means, including transversely-extending frame means defining hollow interior sections, for supporting a craft during the raising, lowering and said wet and dry storage of said craft;

(b) a pair of longitudinally-extending, spaced-apart pontoon means connected to said structural frame means for buoyantly supporting in water said frame means during the raising, lowering and wet storing of said craft; and (c) lift means including lift cables, said lift cables being attached at one end to said lift means and at the other end to the underside of said pontoon means, for securing said lift means to said pontoon means, said lift cables extending from its attachment to said lift means within said hollow interior section to its being secured to the underside of said pontoon means, said pontoon means coacting with said frame means to provide self-adjustability to said system, said craft being raised by lift means pulling said pontoon means in a downward direction with respect to said frame means which in turn moves said frame in an upward direction, and said craft being lowered by said lift means moving said pontoon means in an upward direction with respect to said frame means which in turn moves said frame means in a downward direction.

* * * * *

UNITED STATES PATENT AND TRADEMARK OFFICE

CERTIFICATE OF CORRECTION

PATENT NO. : 4,732,102

DATED : March 22, 1988

INVENTOR(S) : CLIFFORD W. HOLMAN and RALPH V. PEABODY

It is certified that error appears in the above-identified patent and that said Letters Patent is hereby corrected as shown below:

Column 3, line 33, insert --system-- after "storage";

Column 3, line 42, insert --supported thereon.-- after ")";

Column 3, line 52, insert --is a-- after "8"

Column 8, line 17, delete "by".

Signed and Sealed this

Twenty-ninth Day of November, 1988

*Attest:*

DONALD J. QUIGG

*Attesting Officer*

*Commissioner of Patents and Trademarks*